US005078789A

United States Patent [19]

Abodishish et al.

[11] Patent Number: 5,078,789

[45] Date of Patent: Jan. 7, 1992

[54] CONTINUOUS VACUUM DISTILLATION AND FURNACE THEREFOR

[75] Inventors: Hani A. M. Abodishish, Ogden; R. James Adams, West Point, both of Utah

[73] Assignee: Westinghouse Electric Corp., Pittsburgh, Pa.

[21] Appl. No.: 606,637

[22] Filed: Oct. 31, 1990

[51] Int. Cl.[5] ..... C22B 34/10; C22B 9/04

[52] U.S. Cl. ..... 75/611; 75/612; 266/149

[58] Field of Search ..... 266/149; 75/611, 612, 75/10.29

[56] References Cited

U.S. PATENT DOCUMENTS

| | | | |
|---|---|---|---|
| 896,245 | 8/1908 | Reid | 75/10.29 |
| 2,482,127 | 9/1949 | Schlechten et al. | 266/149 |
| 2,960,331 | 11/1960 | Hanks | 75/612 |
| 4,556,420 | 12/1985 | Evans et al. | 75/618 |

*Primary Examiner*—Melvyn J. Andrews
*Attorney, Agent, or Firm*—J. C. Valentine

[57] ABSTRACT

A vacuum distillation furnace and method for removing unreacted magnesium metal and magnesium chloride from a sponge refractory metal, such as zirconium, utilizes a vertically arranged series of mutually isolated distillation vessels in respective furnace sections for continuous or semi-continuous vacuum distillation of the sponge metal following formation thereof by usual reduction procedures.

16 Claims, 1 Drawing Sheet

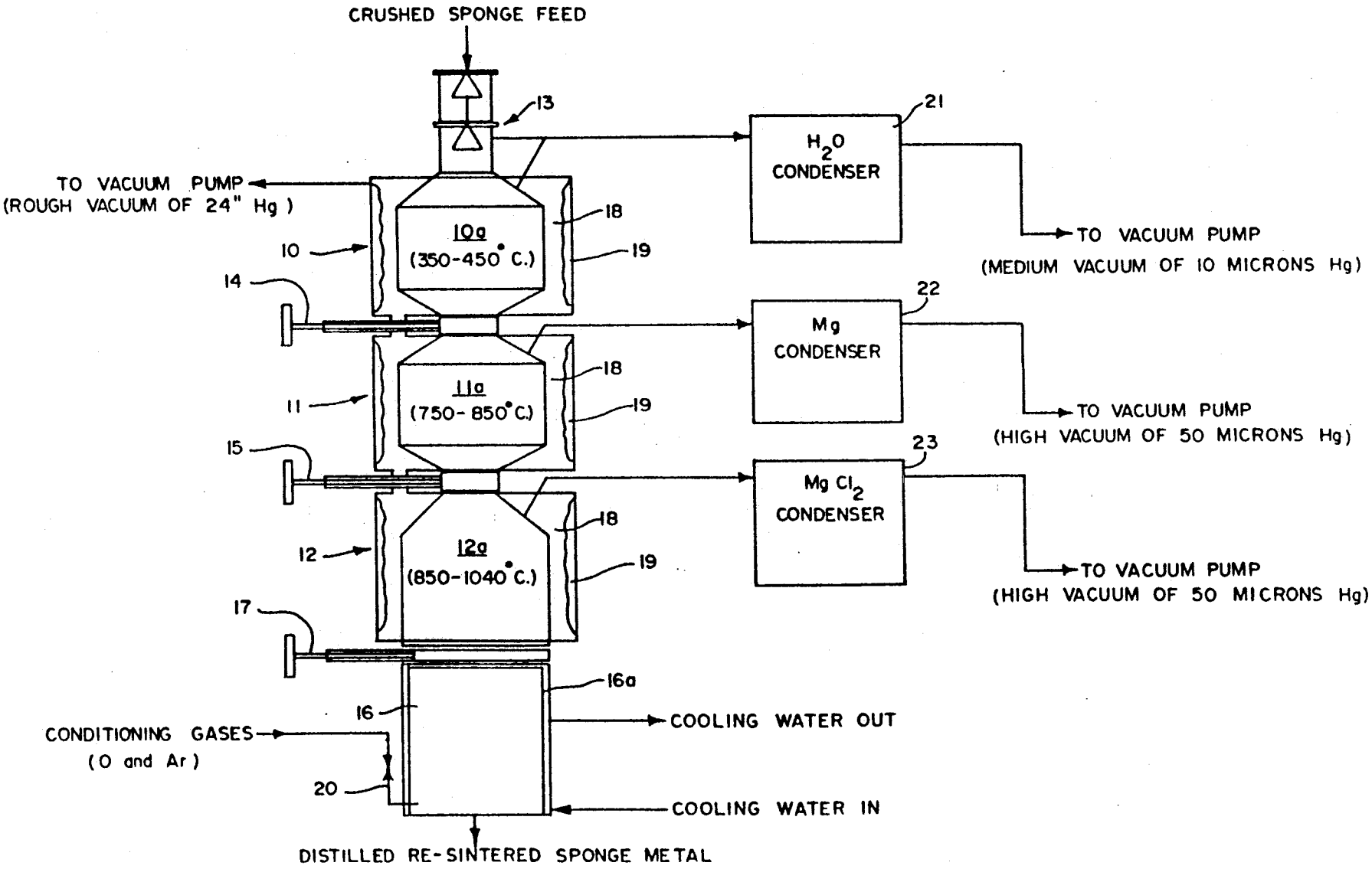
CRUSHED SPONGE FEED
13
TO VACUUM PUMP
(ROUGH VACUUM OF 24" Hg)
10
10a
(350-450° C.)
14
18
19
21
$H_2O$ CONDENSER
TO VACUUM PUMP
(MEDIUM VACUUM OF 10 MICRONS Hg)
11
11a
(750-850° C.)
15
22
Mg CONDENSER
TO VACUUM PUMP
(HIGH VACUUM OF 50 MICRONS Hg)
12
12a
(850-1040° C.)
17
23
$MgCl_2$ CONDENSER
TO VACUUM PUMP
(HIGH VACUUM OF 50 MICRONS Hg)
16
16a
20
CONDITIONING GASES
(O and Ar)
COOLING WATER OUT
COOLING WATER IN
DISTILLED RE-SINTERED SPONGE METAL

CONTINUOUS VACUUM DISTILLATION AND FURNACE THEREFOR

BACKGROUND OF THE INVENTION

1. Field of the Invention

The invention is in the field of the vacuum distillation of sponge refractory metals, such as zirconium and/or hafnium and titanium, and of furnaces for accomplishing the same.

2. Description of the Prior Art

In the production of zirconium and/or hafnium metals, vacuum distillation is conventionally applied to the sponge metal produced by reduction of the metal tetrachloride with magnesium so as to remove both unreacted magnesium and the magnesium chloride produced during the reaction. This is normally done as a batch operation in a single furnace crucible with the furnace temperature raised as required to effect vaporization of the unreacted magnesium and of the magnesium chloride during respective time periods to accomplish removal of these contaminants from the sponge metal product.

SUMMARY OF THE INVENTION

In accordance with the present invention, the operation is carried out on a continuous or semi-continuous basis in a vacuum furnace having a series of furnace sections arranged substantially vertically, the sponge metal feed coming in at the top as crushed sponge metal pieces through a double-gate feeder or equivalent and descending by gravity from section to section under the control of respective gate valves and being discharged at the bottom as fully distilled sponge.

By carrying out the distilation cycle in separate chambers, the unreacted magnesium metal and the magnesium chloride are recovered entirely separately from each other, thereby preventing the recycling of impurities back to the reduction side of the overall process. Only the magnesium metal will be recycled. Impurities such as sub-chlorides will be associated with the magnesium chloride which is normally discarded as waste.

BRIEF DESCRIPTION OF THE DRAWING

The best mode presently contemplated of carrying out the invention in actual practice is shown in the accompanying drawing in which the single FIGURE is a schematic elevational view, partly in vertical section, of the new vacuum furnace of the invention in which the method of the invention is practiced.

DETAILED DESCRIPTION OF THE ILLUSTRATED EMBODIMENT

As illustrated, crushed sponge metal is fed into the upper one of a vertically oriented series of furnace sections, usually three, here indicated from top to bottom of the series as 10, 11, and 12, respectively, the feed being preferably manually controlled by a double gate feeder 13 preferably connected with a series of medium vacuums to minimize air leakage, passage from furnace section to furnace section being preferably controlled by manually operated, high temperature, long stemmed gate valves 14 and 15 so vacuum conditions in the respective sections are isolated one from another. Passage of material from the lowermost furnace section 12 into a discharge chute 16 is manually controlled by a similar gate valve 17.

The furnace sections are differentially heated individually, preferably by individual electrical heating means incorporated therein, which may be of any suitable standard make available on the open market. Each of the furnace sections is provided with an internal distillation vessel 10*a*, 11*a*, and 12*a*, respectively, providing, peripherally thereof, space 18 between it and the exterior furnace wall 19, which spaces 18 are connected in common to a vacuum pump as indicated, that draws a vacuum of sufficient value, for example a rough vacuum of 24" Hg, to more or less compensate for vacuum drawn internally of the vessels 10*a*, 11*a*, and 12*a*, so as to prevent collapse of the walls of these distillation vessels.

Discharge chute 16 is provided with a valved inlet 20 for the introduction of conditioning gases and is cooled, as by the provision of double walls 16*a* between which cooling water is circulated as indicated. The material inlet opening of chute 16 and the outlet opening of vessel 12 are large enough to accommodate the lumps of sponge metal resulting from sintering in vessel 12.

An equivalent series of condensers 21, 22, and 23 (normally water cooled) are connected between the furnace chambers of the vessels 10*a*, 11*a*, and 12*a*, respectively, and respective vacuum pumps, as indicated.

In operation, the distillation vessel chamber 10*a* of furnace section 10 is heated to a temperature between about 350° and about 450° C. for vaporizing moisture from the crushed sponge metal as fed through gate feeder 13. The vaporized moisture is drawn off and condensed as water in condenser 21 under a medium vacuum of 10 microns Hg.

The distillation vessel chamber 11*a* of furnace section 11 is heated to a temperature of about 750° to about 850° C. to vaporize the unreacted magnesium metal in the sponge, which is drawn off and condensed in condenser 22 under a high vacuum of 50 microns Hg.

The distillation chamber 12*a* of furnace section 12 is heated to a temperature of about 850° to about 1000° C. to vaporize the magnesium chloride in the sponge, which is drawn off and condensed in condenser 23 under a high vacuum of 50 microns Hg.

The distilled sponge subjected to sintering in furnace section 12 is then discharged through chute 16 and is cooled as it passes through such chute.

Feed of material from an immediately proceeding furnace section may be cut off during discharge of material from any given furnace section, thereby making the process semi-continuous rather than continuous as it is if feed and discharge are contemporaneous.

The processing cycle is shortened considerably by this sequential processing on a more or less continuous basis, e.g. from the present 200 to 250 hours to a period of from 20 to 25 hours, while replacing about two-thirds of the individual batch furnaces presently employed in a plant for the production of zirconium sponge metal.

Although only three furnace sections are here shown as making up the series, it should be understood that additional furnace sections may be employed to carry out additional steps that may be required in the distillation, by vacuum or under positive pressure, of a sponge metal product.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim as our invention:

1. A vacuum furnace for the more or less continuous distillation of sponge refractory metals, comprising a series of at least three furnace sections having internally isolated distillation vessels, respectively, arranged substantially vertically and independently equipped with heating means for heating the uppermost distillation vessel of said three furnace sections to between about 350° and about 450° C., for heating the intermediate distillation vessel between about 750° and about 850° C., and for heating the lowermost distillation vessel between about 850° and about 1040° C.; air-excluding feeder means for sponge refractory metal leading into the distillation vessel of the uppermost of said three furnace sections; valve means between the distillation vessels of said sections for controlling gravity descent of sponge metal feed from furnace section to furnace section; valve means at the bottom of the distillation vessel of the lowermost of said three furnace sections for controlling discharge of distilled and resintered sponge metal from the distillation vessel of said lowermost of said three furnace sections; respective condenser means connected with the interiors of said distillation vessels for condensing volatiles withdrawn from the respective distillation vessels of said three furnace sections as they evolve; a discharge chute provided with cooling means and communicating with said lowermost distillation vessel through a discharge opening thereof large enough to accommodate resintered sponge metal; and means for establishing substantially compensating vacuum, exteriorly of said distillation vessels to prevent collapse of the walls of said distillation vessels.

2. A vacuum furnace for the continuous distillation of sponge refractory metals, comprising a series of furnace sections having internally isolated distillation vessels, respectively, arranged substantially vertically and independently equipped with heating means, including an uppermost furnace section and a lowermost furnace section, wherein a distillation vessel in the lowermost furnace section has a bottom and wherein the distillation vessels have interiors; air-excluding feeder means for sponge refractory metal leading into the distillation vessel of the uppermost of said furnace sections; respective valve means between the distillation vessels of said sections for controlling gravity descent of sponge metal feed from furnace section to furnace section; valve means at the bottom of the distillation vessel of the lowermost furnace section for controlling discharge of distilled sponge metal from the vacuum furnace; respective condenser means connected with the interiors of said distillation vessels for condensing volatiles withdrawn from the respective distillation vessels of said furnace sections, wherein the condenser means have interiors; respective vacuum means connected with the interiors of said condenser means for withdrawing volatiles from the respective furnace sections as they evolve; and means for heating said distillation vessels to respective distillation temperatures.

3. A vacuum furnace in accordance with claim 2, wherein cooling means for discharged material is associated with the bottom of the lowermost furnace section.

4. A vacuum furnace in accordance with claim 3, wherein the cooling means is incorporated in a discharge chute.

5. A vacuum furnace in accordance with claim 4, wherein the chute is double walled and provided with means for circulating cooling water between the double walls.

6. A vacuum furnace in accordance with claim 2, wherein the vacuum means are pumps connected to the furnace sections, respectively, for withdrawing volatiles therefrom.

7. A vacuum furnace in accordance with claim 2, wherein there are three furnace sections, and the means for heating the furnace sections are respective electrical heaters adapted to heat the uppermost section to about 350° C., to heat the intermediated furnace section to from about 750° to about 800° C., and to heat the lowermost furnace section to from about 850° to about 950° C.

8. A vacuum furnace in accordance with claim 2, wherein the valve means are gate valves and the air-excluding feeder means is a double gate valve.

9. A vacuum furnace in accordance with claim 8, wherein the gate valves are manually operable.

10. A vacuum furnace in accordance with claim 2, wherein the distillation vessels have walls and including means for establishing substantially compensating vacuum conditions externably of said distillation vessels to prevent collapse of the walls of said distillation vessels.

11. A method of continuously distilling volatiles from a sponge refractory metal, comprising the steps of introducing a sponge refractory metal containing volatiles into a vacuum furnace having an uppermost furnace section and a lowermost furnace section, each furnace section having a distillation vessel, wherein the metal is introduced into the distillation vessel in the uppermost furnace section, while maintaining said uppermost section closed to the atmosphere; passing said metal from distillation vessel to distillation vessel of said furnace sections of the series by gravity flow; subjecting said metal to progressive vacuum distillation in said series of furnace sections as it descends from section to section; separately withdrawing and condensing distilled volatiles from said furnace sections; and discharging said sponge metal from the lowermost furnace section of said series.

12. A method in accordance with claim 11, wherein gravity flow of sponge metal from any given furnace section is restrained as the sponge metal is discharged from the immediately subsequent furnace section.

13. A method in accordance with claim 11, wherein gravity flow of sponge metal from any given furnace section is substantially contemporaneous with discharge of sponge metal from the immediately subsequent furnace section.

14. A method in accordance with claim 11, wherein there is a series of at least three furnace sections, the sponge refractory metal is zirconium, and the distillation vessel of the uppermost furnace section of said series is maintained at from about 350° to about 450° C. under a medium vacuum, the distillation vessel of the intermediate furnace section of said series is maintained at from about 750° to about 850° C. under a high vacuum, and the distillation vessel of the lowermost furnace section of said series is maintained at from about 850° to about 1040° C. under a high vacuum.

15. A method in accordance with claim 14, wherein the discharging sponge metal from the distillation vessel of the lowermost furnace section of the three furnace sections is cooled during the discharging.

16. A method in accordance with claim 11, wherein vacuum conditions are maintained outside of said distillation vessels to substantially compensate for vacuum conditions within said vessels to prevent collapse of said vessels.

* * * * *